US006527611B2

(12) United States Patent
Cummings

(10) Patent No.: US 6,527,611 B2
(45) Date of Patent: Mar. 4, 2003

(54) PLACE AND FIND TOY

(76) Inventor: Charles A. Cummings, 5719 Thomaridge Dr., Cincinnati, OH (US) 45248

( * ) Notice: Subject to any disclaimer, the term of this patent is extended or adjusted under 35 U.S.C. 154(b) by 0 days.

(21) Appl. No.: 09/783,276

(22) Filed: Feb. 9, 2001

(65) Prior Publication Data

US 2002/0111115 A1 Aug. 15, 2002

(51) Int. Cl.[7] ..... A63H 30/00
(52) U.S. Cl. ..... 446/175; 446/297
(58) Field of Search ..... 446/175, 397, 446/353, 352, 330, 298, 299, 301, 300, 302, 303, 297

(56) References Cited

U.S. PATENT DOCUMENTS 3,384,074 A * 5/1968 Rautiola et al. ..... 446/297
4,809,335 A * 2/1989 Rumsey ..... 446/175
4,820,236 A * 4/1989 Berliner et al. ..... 446/369
5,267,886 A * 12/1993 Wood et al. ..... 446/175
5,288,069 A * 2/1994 Matsumoto ..... 446/484
5,316,516 A * 5/1994 Saitoh ..... 446/175
5,324,225 A * 6/1994 Satoh et al. ..... 446/175
5,356,326 A * 10/1994 Ting ..... 446/175
5,376,038 A * 12/1994 Arad et al. ..... 446/297
5,944,533 A * 8/1999 Wood ..... 434/167
5,989,091 A * 11/1999 Rodgers ..... 446/297
6,017,261 A * 1/2000 Wachtel ..... 446/353
6,066,161 A * 5/2000 Parella ..... 446/175
6,071,166 A * 6/2000 Lebensfeld et al. ..... 446/175
6,149,490 A * 11/2000 Hampton et al. ..... 446/353
6,227,931 B1 * 5/2001 Shackelford ..... 446/268

* cited by examiner

*Primary Examiner*—Derris H. Banks
*Assistant Examiner*—Urszula M Cegielnik
(74) *Attorney, Agent, or Firm*—Dwight A. Stauffer

(57) ABSTRACT

The place and find toy, generally a doll or stuffed animal, has a circuit with a programmable computer controlled voice synthesizer. The circuit of the toy, when activated by an on-switch, synthesizes a first series of phrases to encourage a human player to find it. When the toy is subsequently found and moved, a motion activated switch causes the synthesizer to stop the first series of phrases and start a second series of phrases. The second series of phrases thanks and/or praises the player who finds the toy. The circuit then turns off the toy until the cycle is restarted by activating the on-switch. Optionally, a programmed delay time causes a delay from when the on-switch is activated until the motion activated switch is enabled.

20 Claims, 2 Drawing Sheets

PLACE AND FIND TOY

BACKGROUND OF THE INVENTION

The present invention is concerned with talking toys; that is, toys with voice synthesizers. Further, the present invention is concerned with toys that can be incorporated into games and activities similar to the traditional game of "Hide and Seek." The toy of the present invention synthesizes voices to encourage the participants to find it and thanks the participants when found.

There are many interactive toy patents that relate to sound or light recognition technology. A few of these patents incorporate the hide and seek game concept into the toy. For example, U.S. Pat. No. 4,298,719 discloses a toy with a series of buttons that trigger random actions. U.S. Pat. No. 4,496,149 uses controllable audio signals in a game apparatus. This patent discloses a game apparatus employing a container having an electronic circuit which can emit a repetitive audio signal of controllable volume and repetition rate. The game apparatus includes a compartment into which a prize or award is placed by the players. The container is hidden by one of the players who selects the repetition rate and volume for the signals. The other players then attempt to locate the apparatus with container in response to the signals, and the first player to find the container wins the prize. The degree of difficulty is determined by the volume and repetition rate of the signal which is controlled by the player hiding the game.

U.S. Pat. No. 4,961,575 discloses a hide and seek game comprising of an apparatus which has a plurality of portable units. Each portable unit is carried by each game player. Each portable unit generates output signals to define an output signal field near the hiding player. The invention has technology that measures field strength so when one player with a unit gets closer to another unit each unit emits an indicating signal. U.S. Pat. No. 4,840,602 teaches a talking doll responsive to external signal. This invention cooperates with a remote signal source which provides a narration with which the doll interacts. This doll has a vocabulary stored in digital form in memory which may be accessed by a speech synthesizer to respond to the signal source. The doll has a radio frequency receiver which receives encoded data from a remote signal source, and a central processing unit which accesses the memory for selected speech data to simulate the doll's response.

U.S. Pat. No. 5,413,518 discloses and invention with a proximity response. This work includes a motor driven drive unit for propelling the toy, and a variable frequency oscillatory unit including a capacitor plate for sensing the approach a capacitive body. This work has a frequency output that decreases in response to the proximity of the capacitive body to the toy. U.S. Pat. No. 5,942,969 discloses a treasure hunt game using a pager and a paging system. Participants receive information and clues from the paging system to direct them to a particular landmark or location. Once near the landmark, the participants signal the system with a response which is dependent on their presence at the correct location.

BRIEF SUMMARY OF THE INVENTION

"Hide and Seek" is a traditional children's game. The present invention is concerned with a toy that a child or children can invite into a game similar to "hide and seek." The present invention is a toy form, preferably a stuffed animal, (or a doll), which when hid and activated, will synthesize one or more traditionally appropriate phrases encouraging the child to find the speaking toy. After the toy is found and motion applied, the toy will, in turn, shut off the first appropriate phrases; and commence the second appropriate phrases which second phrases will thank the child (or voice other second appropriate phrases). After the second phrases are synthesized, the toy will "shut itself off" until reactivated to restart the cycle.

When the toy is activated in the first phase; whether by a manual switch and in the described embodiment, or by a remote switch activated by radio, sound, or light; the switch activates the toy computer/voice synthesizer to create first appropriate phrases to attract the player to the toy. There will be a programmed delay after the manual switch is activated to allow the first appropriate phrases to be voiced for a time so that the toy can be moved. After this programmed delay the computer chip will allow the motion activated on switch to be activated. When the toy is found by the player and moved to activate the second phase of the cycle, the voice synthesizer will cease the synthesis of the first phrases and commence to synthesize second appropriate phases. At this time the circuit will "shut off" and will need to be reactivated to start the process over.

It is to be understood that modern electronics provide a great deal of flexibility in design. While the detailed disclosures will specify one method of producing the present invention, clearly, there could be alternative circuit designs and computer/voice synthesizers.

DETAILED DESCRIPTION OF THE INVENTION

Figure 1:
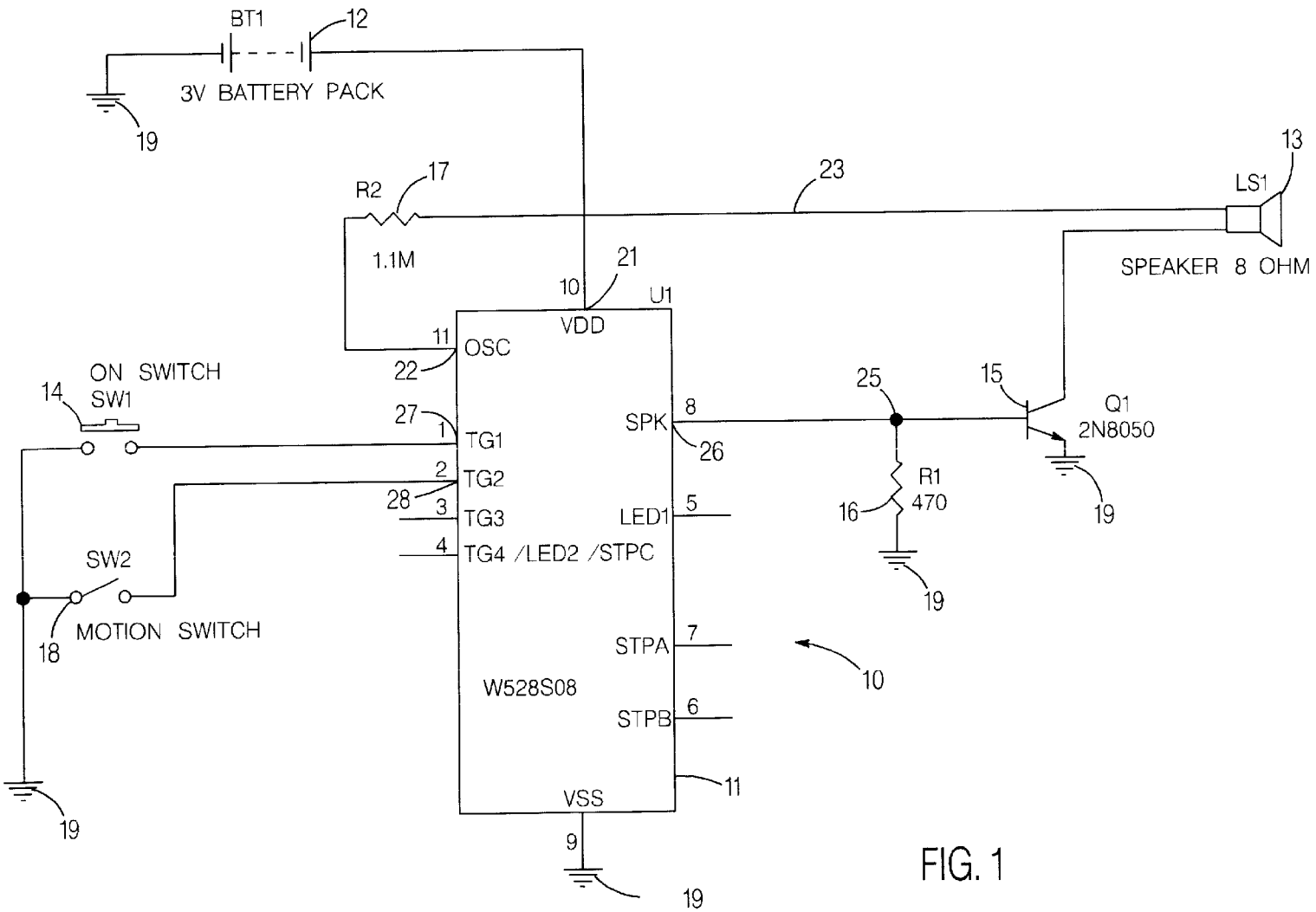
FIG. 1 is a schematic of an electronic circuit for a preferred embodiment of the invention.
Figure 2:
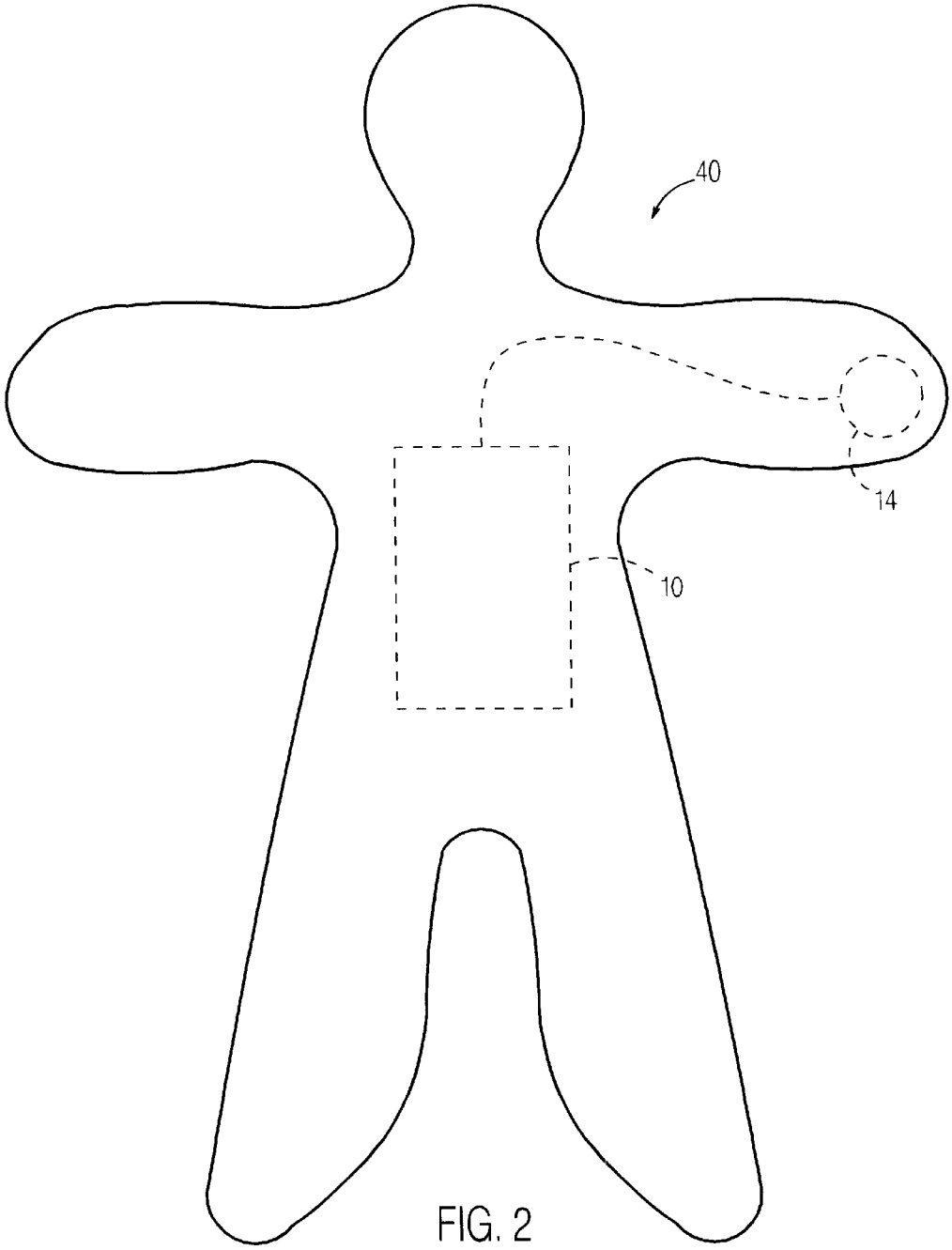
FIG. 2 is a toy form such as a stuffed animal or doll incorporating the electronic circuit of FIG. 1, according to a preferred embodiment of the invention.

Toys are the learning tools of childhood. Referring to FIGS. 1 and 2, the specific embodiment of the present invention is a cuddly stuffed animal form 40 which is often treated as if it were a human form doll. Thus, a stuffed animal 40 as in the present embodiment would have traditional phrases used in "Hide and Seek." In the first or hiding part of the game the toy 40 would voice such first appropriate phrases as "Find me," or "You're getting close," and so forth. In a second phase when the toy 40 is found, and received enough motion to activate a motion activated switch 18, a voice synthesizer 11 would cease producing the first appropriate phrases and would commence to produce such second appropriate phrases as "You have found me, give me a hug," or "You're so big that you can find me." However, the number of toy forms 40 is limited only by the imagination of the toy designer.

For example, the operating invention could be used in a boyhood game of "war." An alternative kind of toy form 40 such as a toy soldier could synthesize first approach phrases useful in play battle such as "Help, we are under attack" or, "Medic! I'm hit." In a second phase when the toy soldier is found, moved to activate the motion activated switch 18, the voice synthesizer will create such second appropriate phrases as, "Am I going to make it?" or "Patch me up so I can get back."

These two types of toys illustrate the elements of the present invention. That is, when the toy 40 is activated in the first phase; whether by a manual switch 14 and in the described embodiment, or by a remote switch activated by radio, sound, or light; the switch 14 activates the toy computer/voice synthesizer 11 to create first appropriate phrases to attract the player to the toy. There will be a programmed delay after the manual switch 14 is activated to allow the first appropriate phrases to be voiced for a time so that the toy 40 can be moved. After this programed delay the computer chip will allow the motion activated on switch 18 to be activated. When the toy 40 is found by the player and moved to activate the second phase of the cycle, the voice synthesizer 11 will cease the synthesis of the first phrases and commence to synthesize second appropriate phases. At this time the circuit 10 will "shut off" and will need to be reactivated to start the process over.

The unique features of game play taught by the present invention can be implemented using a variety of simple, inexpensive electronic elements. A preferred embodiment is now described.

The starting reference point of the schematic in FIG. 1 is a programmable microchip computer controlled voice synthesizer 11. Voice synthesizer computer chip 11 sold under the code, W528S08 is manufactured by Winbond Electronics Corporation, Taiwan. This kind of chip is a commodity article useful for the present invention. Manual switch 14, the motion activated on switch 18, the battery pack power source 12, and the speaker 13, are interconnected through chip 11 and the ground connections 19. Computer chip 11 is grounded to ground 19 through pin VSS. The electric battery power source 12 connects through its ground to send power for the computer controlled voice synthesizer 11 through connector 21 to pin VDD. An voice output pin OSC of the chip 11 is connected via connector section 22 to resister 17 which in turn is connected through connector segment 23 to speaker 13. Speaker 13 is a commodity article. The electrical subcircuit for speaker 13 to complete the electrical circuit to the computer chip is resistor controlled transistor 15 type 2N8050. The circuit to be amplified is grounded through 19. The connection 26 between transistor 15 and the computer chip 11 is grounded by a second resistor 16 through connector section 25. The connection 26 is attached to the computer chip 11 at pin SPK. The computer chip 11 is activated by manual "ON" switch 14, which connects the ground and connector section 27. Connector section 27 in turn connects to pin TG1 on computer chip 11. Manual switch 14 is located on the front of the doll. Motion switch 18 connects between the ground through connector section 28 to pin TG2 on computer chip 11. When activated ("turned on") by motion the computer chip 11 will deactivate the first appropriate phrases and induce the programmed chip 11 to produce the second appropriate phrases. Note the computer chip 11 is programmed to produce first appropriate phrases when activated by manual switch 14. However, the computer chip 11 is further programmed to prevent for a limited time the motion switch 18 from starting second appropriate phrases after the manual switch 14 is activated. This limited time will allow the toy 40 to be moved and placed without the production of second appropriate phrases. Once the limited time elapses the computer chip 11 will product second appropriate phrases. The first and/or second phrases can be reproduced in set times, such as about 30 seconds.

The chip 11 is programmed to shut down in the period when it is producing the first appropriate phrases if the toy is not found in a certain period of time (about 30 minutes) and the motion detector switch 18 is not activated. However, once the toy is found and moved, the chip 11 is programmed to turn off first appropriate phrases, and commence the production of second appropriate phrases. The chip 11 is programmed to turn itself off after the production of a number of repetitions of second appropriate phrases.

The cycle is restarted by the activation of manual switch 14.

I claim:

1. An interactive toy for interactive hide and seek game playing with a player, the interactive toy comprising:

a programmable voice synthesizer chip means for periodically with a first time delay voicing phrases for encouraging the player to find the interactive toy;

a compression switch means for turning on the programmable voice synthesizer chip means to initiate the interactive hide and seek game playing; and a motion activated switch means for signaling the programmable voice synthesizer chip means to stop periodically voicing the phrases for encouraging the player to find the interactive toy, to voice phrases for thanking and praising the player, and to turn off the interactive toy after voicing the phrases for thanking and praising the player.

2. The interactive toy of claim 1, further comprising:

a programmable voice synthesizer chip means for making operable the motion activated switch means at a second time delay after the programmable voice synthesizer chip is turned on.

3. The interactive toy of claim 1, further comprising:

a programmable voice synthesizer chip means for automatically turning off the interactive toy if the motion activated switch means has not signaled the programmable voice synthesizer chip means after a third time delay after the programmable voice synthesizer chip is turned on.

4. The interactive toy of claim 3, wherein:

the third time delay is an integer multiple of the first time delay, such that the third time delay can be specified as a count of the number of periodic voicings of the phrases for encouraging the player to find the interactive toy.

5. The interactive toy of claim 1, wherein:

the second time delay is equal to the first time delay.

6. The interactive toy of claim 1, wherein:

the first time delay is thirty seconds.

7. The interactive toy of claim 1, further comprising:

a body in the form of a stuffed animal or doll having at least one arm wherein the compression switch means is in an outer end of the arm.

8. The interactive toy of claim 1, wherein:

when the programmable voice synthesizer chip means is turned on to initiate the interactive hide and seek game playing, the programmable voice synthesizer chip means immediately voices phrases for encouraging the player to find the interactive toy.

9. The interactive toy of claim 1, wherein:

the programmable voice synthesizer chip means consists of a single integrated circuit chip.

10. A method for an interactive toy to conduct a hide and seek game with a child, the method comprising the steps of:

in response to the child compressing the interactive toy, turning on the interactive toy;

immediately after turning on the interactive toy, conducting the hide and seek game by periodically, with a first time delay, voicing phrases for encouraging the child to find the interactive toy;

in response to the child moving the interactive toy, stopping periodically voicing phrases for encouraging the child to find the interactive toy, and starting voicing phrases for thanking and praising the child; and after voicing a predetermined sequence of phrases for thanking and praising the child, turning off the interactive toy, thereby ending the hide and seek game.

11. The method of claim 10, further comprising the step of:

making the response to the child moving the interactive toy operable at a second time delay after the interactive toy is turned on.

12. The method of claim 10, further comprising the step of:

automatically turning off the interactive toy if the child does not move the interactive toy within a third time delay after the interactive toy is turned on.

13. The method of claim 12, wherein:

the third time delay is an integer multiple of the first time delay, such that the third time delay can be specified as a count of the number of periodic voicings of the phrases for encouraging the player to find the interactive toy.

14. The method of claim 10, wherein:

the second time delay is equal to the first time delay.

15. The method of claim 10, wherein:

the first time delay is thirty seconds.

16. The method of claim 10, further comprising the steps of:

providing the interactive toy with a body in the form of a stuffed animal or doll having at least one arm; and positioning compression sensing means in an outer end of the arm.

17. The method of claim 10, further comprising the step of:

in response to turning on the interactive toy, immediately voicing phrases for encouraging the player to find the interactive toy.

18. The method of claim 10, further comprising the step of:

turning off the interactive toy immediately after voicing a predetermined sequence of phrases for thanking and praising the child.

19. A method for a toy to conduct an interactive game with a player, the method comprising the steps of:

in response to the player compressing the interactive toy, turning on the toy to immediately begin conducting the interactive game;

voicing first phrases periodically with a first time delay;

in response to the player moving the toy, stopping voicing first phrases periodically and starting voicing second phrases; and after voicing a predetermined sequence of second phrases, turning off the toy, thereby ending the interactive game.

20. The method of claim 19, further comprising the step of:

automatically turning off the toy if the player does not move the toy within a third time delay after the toy is turned on.

* * * * *